US008220547B2

(12) United States Patent
Craig et al.

(10) Patent No.: US 8,220,547 B2
(45) Date of Patent: Jul. 17, 2012

(54) METHOD AND APPARATUS FOR MULTILATERAL MULTISTAGE STIMULATION OF A WELL

(75) Inventors: Skeates Craig, Calgary (CA); Gary E. Gill, Calgary (CA); Abbas Mahdi, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 251 days.

(21) Appl. No.: 12/685,513

(22) Filed: Jan. 11, 2010

(65) Prior Publication Data

US 2011/0024121 A1 Feb. 3, 2011

Related U.S. Application Data

(60) Provisional application No. 61/213,949, filed on Jul. 31, 2009.

(51) Int. Cl.
*E21B 43/26* (2006.01)
*E21B 43/267* (2006.01)

(52) U.S. Cl. ..... 166/308.1; 166/308.2; 166/177.5

(58) Field of Classification Search ..... 166/308.1, 166/308.2, 177.5, 313
See application file for complete search history.

(56) References Cited

U.S. PATENT DOCUMENTS

| | | | | |
|---|---|---|---|---|
| 6,446,727 | B1 | 9/2002 | Zemlak | |
| 6,615,920 | B1 * | 9/2003 | Collins et al. | 166/313 |
| 7,441,604 | B2 | 10/2008 | Green | |
| 2003/0051876 | A1 | 3/2003 | Tolman | |
| 2003/0221843 | A1 | 12/2003 | Fipke | |
| 2006/0207763 | A1 * | 9/2006 | Hofman | 166/281 |
| 2007/0158073 | A1 | 7/2007 | Green | |

* cited by examiner

*Primary Examiner* — Cathleen Hutchins
(74) *Attorney, Agent, or Firm* — Robert A. Van Someren; Wayne I. Kanak

(57) ABSTRACT

A method enables stimulation of a well having a plurality of lateral wellbores. The method comprises deploying fracturing equipment downhole for isolated interaction with each lateral wellbore of the plurality of lateral wellbores. The method and the fracturing equipment are designed to enable fracturing of the plurality of lateral wellbores during a single mobilization.

6 Claims, 19 Drawing Sheets

METHOD AND APPARATUS FOR MULTILATERAL MULTISTAGE STIMULATION OF A WELL

CROSS-REFERENCE TO RELATED APPLICATION

The present application claims priority from U.S. Provisional Application 61/213,949, filed Jul. 31, 2009, which is incorporated herein by reference.

BACKGROUND OF THE INVENTION

Exploitation of oil and gas reserves can be improved by using wells with more than one well branch or lateral. The multiple well laterals provide a viable approach to improving well productivity and recovery efficiency while reducing overall development cost. Additionally, multistage fracturing technologies have emerged, but none of these technologies have been adequately utilized for multilateral wells. For example, multistage perforations and plugs have been employed in some multilateral wells, but existing techniques provide no wellbore isolation and no focused fracturing placement. Also, existing multilateral completions do not allow the continuous pumping of fracturing fluid, because of the requirement that the next well zone be opened up with a perforation run on coiled tubing or wireline.

BRIEF SUMMARY OF THE INVENTION

In general, the present invention provides a technique for preparing and stimulating a well. The technique comprises deploying fracturing equipment downhole into a well having a plurality of lateral wellbores. The technique and the fracturing equipment are designed to enable fracturing of the plurality of lateral wellbores during a single mobilization, e.g. a single mobilization of a fracturing unit(s), crew and rig.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique that utilizes multilateral, multistage fracturing to provide an efficient approach to stimulation of wells. The fracturing technique may be run with either open hole systems or cased hole systems and enables continuous fracturing of multiple laterals in a single mobilization, e.g. a single mobilization of a fracturing unit (or units), crew and rig, sometimes referred to as a single rig-up.

In order to accomplish continuous fracturing of a plurality of lateral wellbores in a single mobilization, the technique utilizes plugs or other suitable isolation devices to isolate lateral wellbores and to enable the fracturing of specific lateral wellbores. A fracturing tubing string is hydraulically connected to one lateral wellbore at a time, and a fracturing flow is directed at that specific lateral wellbore in a manner to achieve the desired fracturing. As soon as the first lateral wellbore is fractured, the fracturing tubing string is isolated from the fractured lateral. Depending on the application, the isolation can be achieved with the aid of a variety of tools and techniques, such as an intervention tool, a hydraulic control line operation, a pressure pulsing technique, or another technique employed to hydraulically isolate the tubing string from the lateral wellbore just previously fractured. Additionally, the fracturing tubing string is then moved and connected to the next lateral wellbore to be fractured. Two or more lateral wellbores may be completed in this manner.

The technique enables exploitation of hydrocarbon, e.g. oil and/or gas, reservoirs with more than one well branch, or lateral wellbore, by improving productivity and recovery efficiency while reducing overall cost. The multilateral, multistage approach may be used in a variety of environments, including low permeability and naturally fractured reservoirs. The formation of multiple lateral wellbores improves the likelihood of completing economic wells. For example, horizontal laterals, along with hydraulic fracturing, increase well productivity in "tight" formations. Lateral wellbores perpendicular to natural fractures can significantly improve well output.

Figure 1:
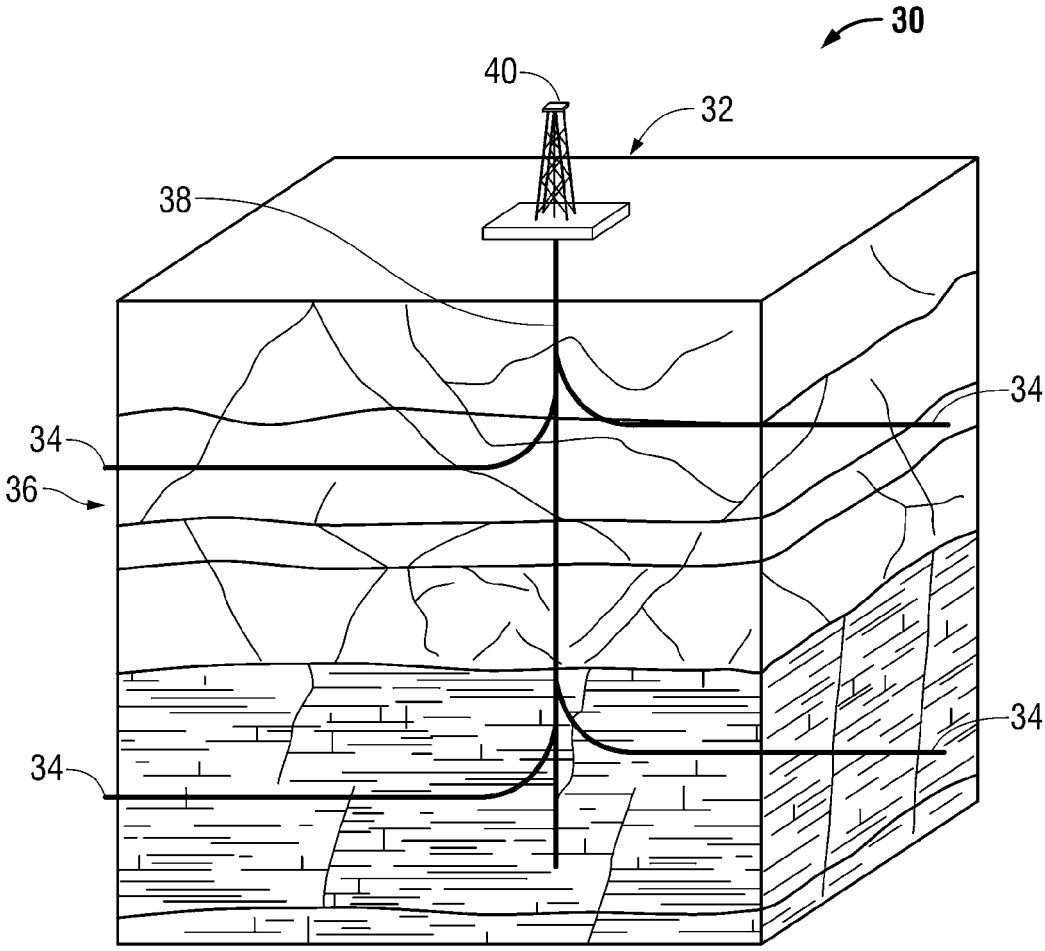
FIG. 1 is a view of a multilateral well system with a plurality of multilateral wellbores deployed along a hydrocarbon bearing reservoir, according to an embodiment of the present invention.

Referring generally to FIG. 1, one embodiment of a well system 30 is illustrated as having a well 32 with a plurality of laterals, i.e. lateral wellbores 34. The lateral wellbores 34 are formed through one or more subterranean reservoirs 36 to enable production of oil and/or gas. In the example illustrated, a generally vertical wellbore 38 is drilled downwardly beneath surface equipment 40, e.g. a rig and/or fracturing unit, and lateral wellbores 34 are formed in a lateral direction extending away from the generally vertical wellbore 38. By way of example, the lateral wellbores 34 may be substantially horizontal wellbores. As described in greater detail below, the multilateral well 32 may be completed and stimulated according to differing techniques. For example, each lateral wellbore 34 may be drilled and completed independently. Alternatively, however, all of the lateral wellbores 34 may initially be drilled and then batch completed.

Figure 2:
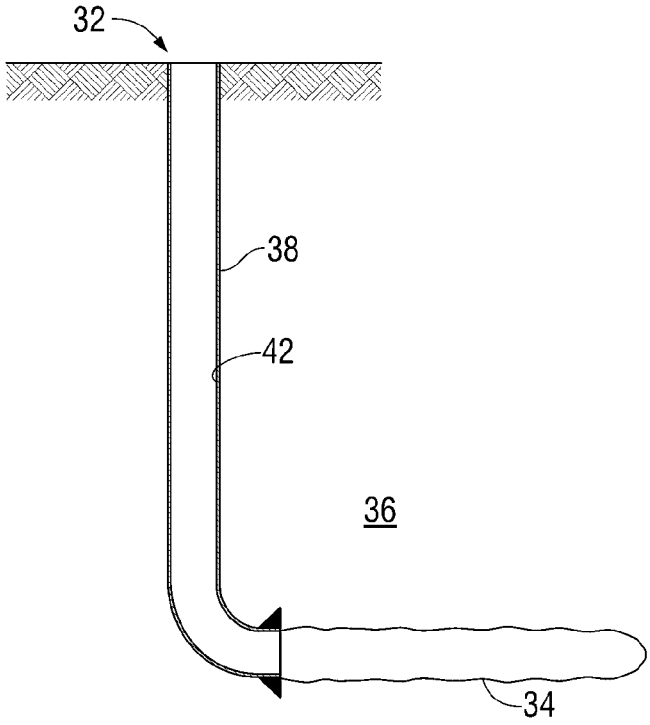
FIG. 2 is a schematic view of a well in which an initial lateral wellbore has been formed, according to an embodiment of the present invention.

According to one embodiment of the present invention, lateral wellbores 34 are drilled and completed sequentially during a single mobilization, e.g. rig-up, and one embodiment of this approach is illustrated and described with reference to FIGS. 2-12. Referring first to FIG. 2, an initial stage of this approach is illustrated in which a first lateral wellbore 34 is drilled into a desired region of reservoir 36. A casing 42 also may be deployed along vertical wellbore section 38 down to the first lateral wellbore 34. It should be noted that the multilateral, multistage technique described herein can be utilized with both open hole and cased wellbores.

Figure 3:
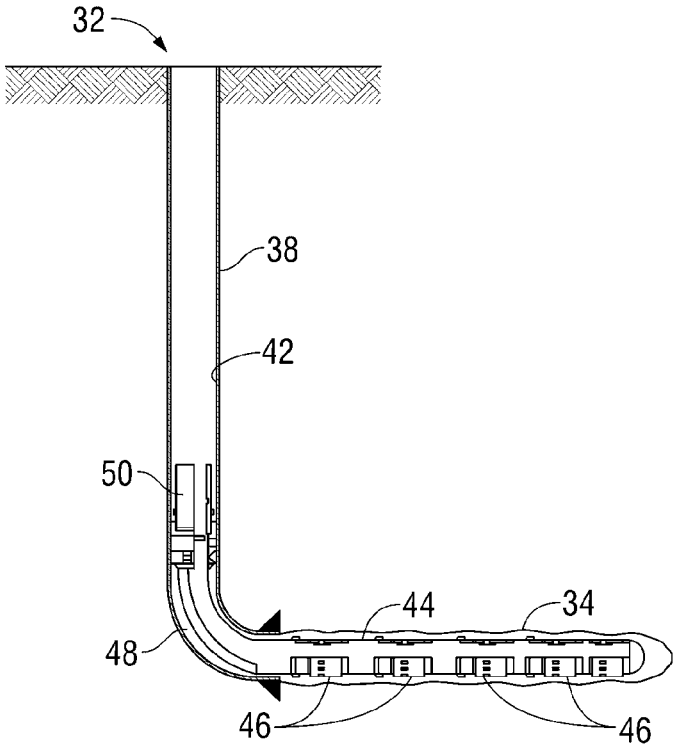
FIG. 3 is an illustration of the lateral wellbore of FIG. 2 with a liner, according to an embodiment of the present invention.

In the example illustrated, the first lateral wellbore 34 is subsequently lined with a liner 44 that may have a plurality of casing valves 46, as illustrated in FIG. 3. The liner 44 is cemented in place in lateral wellbore 34 and engaged with a liner hanger assembly 48. Additionally, an on-off tool 50 is disposed at an upper portion of the liner hanger assembly 48 to selectively receive a fracturing string.

Figure 4:
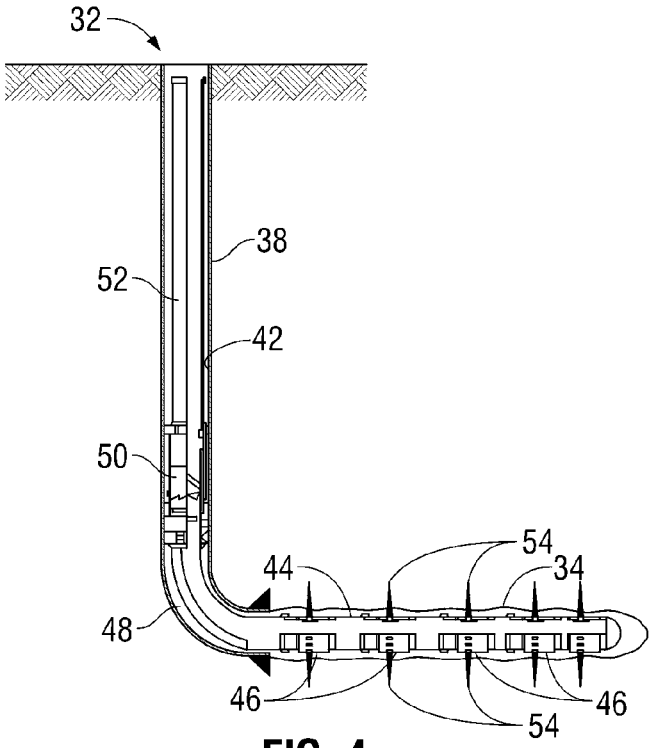
FIG. 4 is an illustration similar to that of FIG. 3 but with a fracturing tubing string deployed, according to an embodiment of the present invention.

As illustrated in FIG. 4, for example, a fracturing tubing string 52 is lowered into multilateral well 32 and latched with on-off tool 50. This enables performance of a desired fracturing procedure in the initial lateral wellbore 34. By pumping fracturing fluid into the lateral wellbore 34 and through valves 46, multiple fractures 54 are created and/or expanded in the surrounding reservoir rock. In some applications, mill darts may be used to facilitate the multistage fracturing process.

Figure 5:
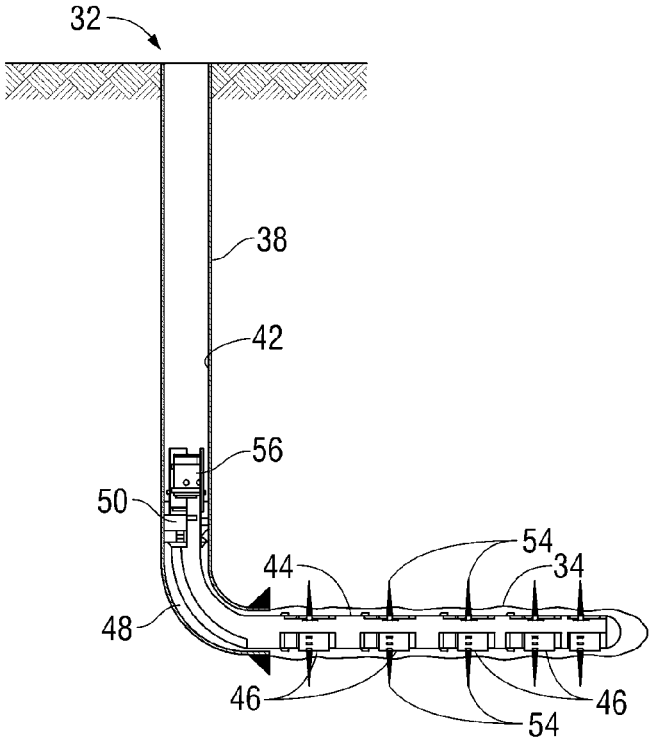
FIG. 5 is an illustration similar to that of FIG. 3 in which the initial lateral wellbore has been isolated, according to an embodiment of the present invention.
Figure 6:
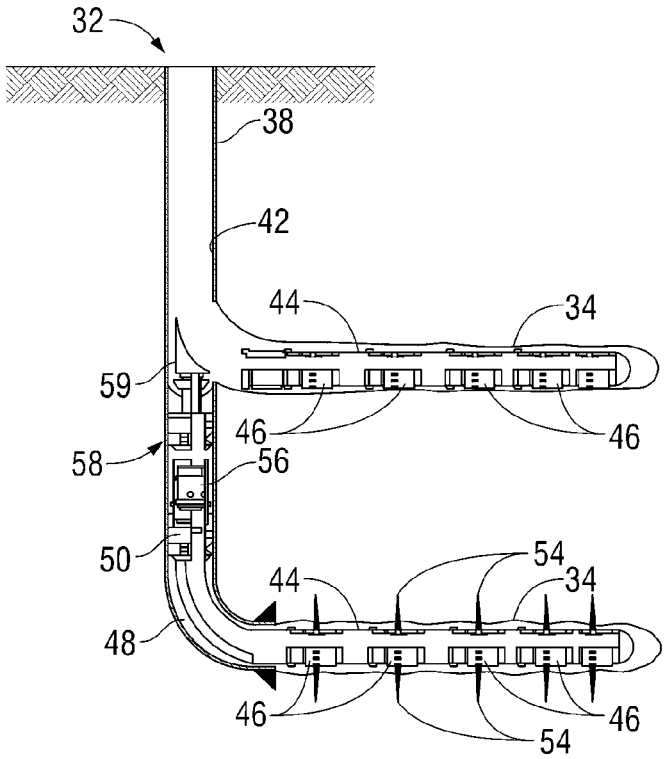
FIG. 6 is an illustration of the well in which an additional lateral wellbore has been formed, according to an embodiment of the present invention.

Once the initial lateral wellbore 34 has been fractured, the fracturing tubing string 52 is disconnected to enable deployment of an isolation device 56, such as a plug, as illustrated in FIG. 5. The isolation device 56 isolates the initial lateral wellbore 34 to enable formation and fracturing of a subsequent lateral wellbore. As illustrated in FIG. 6, a subsequent lateral wellbore 34 is drilled and lined with another liner 44 which is then cemented into place. As with the first lateral wellbore, the subsequent liner 44 may comprise a plurality of casing valves 46. It should be noted that the description herein relates to the formation of two lateral wellbores 34, but the approach may be repeated for additional lateral wellbores to create the desired multilateral well 32. As further illustrated in FIG. 6, a whipstock assembly 58 having a whipstock 59 may be used to facilitate formation of an opening in casing 42 and drilling of the second lateral wellbore 34.

Figure 7:
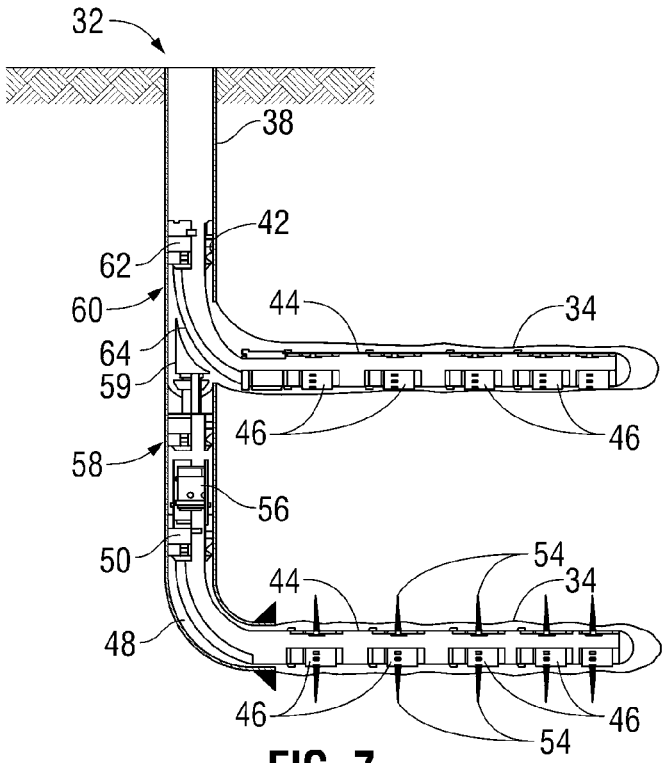
FIG. 7 is an illustration similar to that of FIG. 6 in which the additional lateral wellbore has been prepared for fracturing, according to an embodiment of the present invention.
Figure 8:
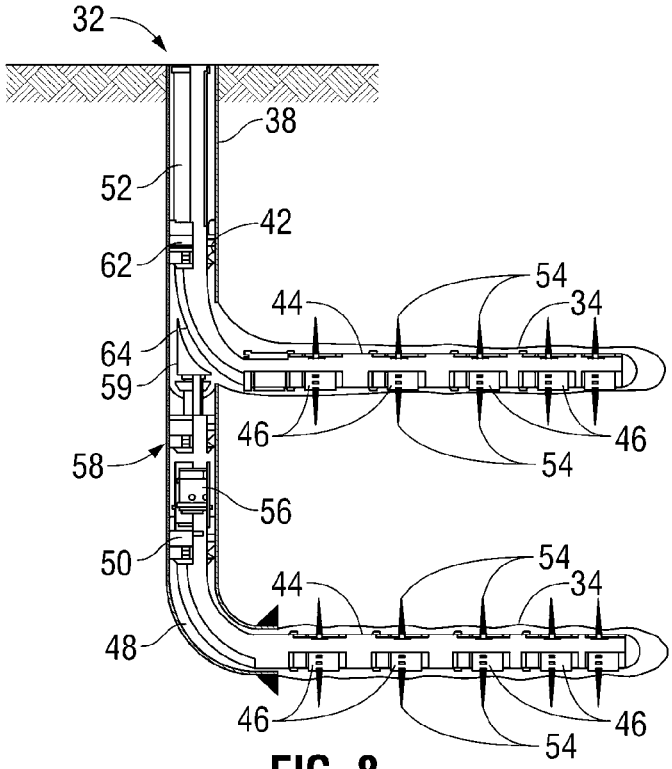
FIG. 8 is an illustration similar to that of FIG. 7 but showing the fracturing tubing string deployed to the additional lateral wellbore, according to an embodiment of the present invention.

Subsequently, a seal assembly 60 may be run downhole and engaged with liner 44 of the second lateral wellbore 34, as illustrated in FIG. 7. By way of example, seal assembly 60 may comprise a packer 62 and a casing or tubing 64 extending between packer 62 and liner 44. The fracturing tubing string 52 is then run downhole into engagement with packer 62, as illustrated in FIG. 8. Once engaged, the fracturing procedure may be performed on the subsequent lateral wellbore 34 to create fractures 54, as illustrated. Again, mill darts or other similar devices may be used to facilitate the multistage fracturing procedure on the subsequent lateral wellbore.

Figure 9:
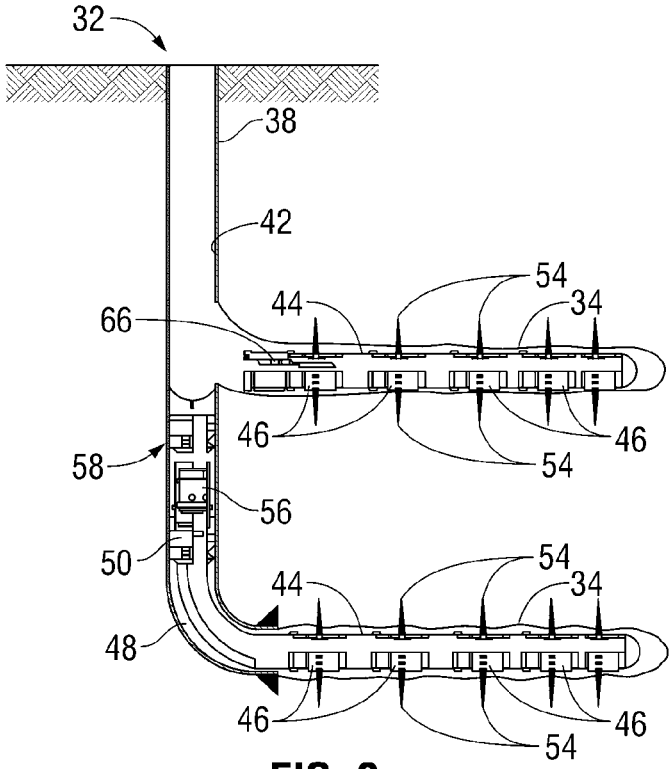
FIG. 9 is an illustration similar to that of FIG. 8 but showing the fracturing tubing string removed, according to an embodiment of the present invention.

Upon completion of the fracturing procedure, the fracturing tubing string 52 is removed along with packer 62 and tubing 64. A suitable permanent packer 66 may then be mounted on the top or near end of liner 44 in the subsequent lateral wellbore 34, as illustrated in FIG. 9. Additionally, the whipstock 59 also may be unlatched and removed from the well.

Figure 10:
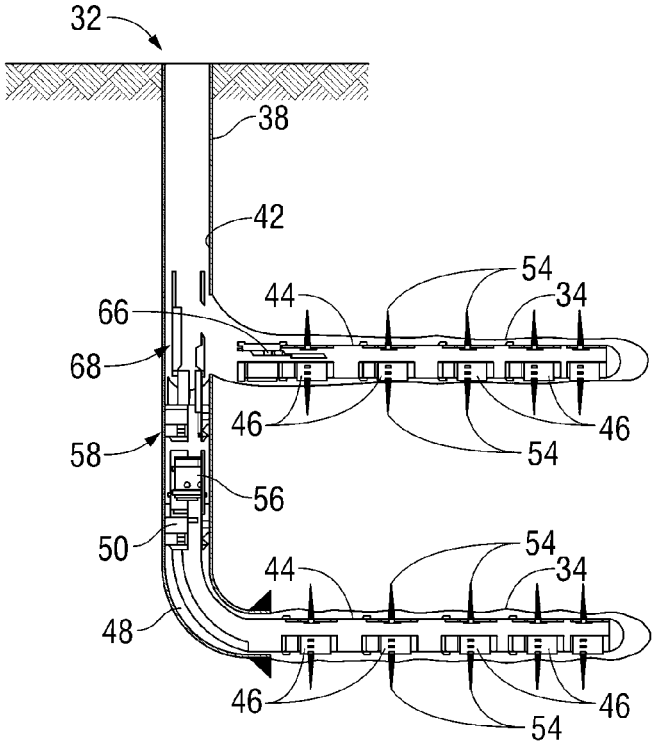
FIG. 10 is an illustration similar to that of FIG. 9 showing preparation of the well for production, according to an embodiment of the present invention.
Figure 11:
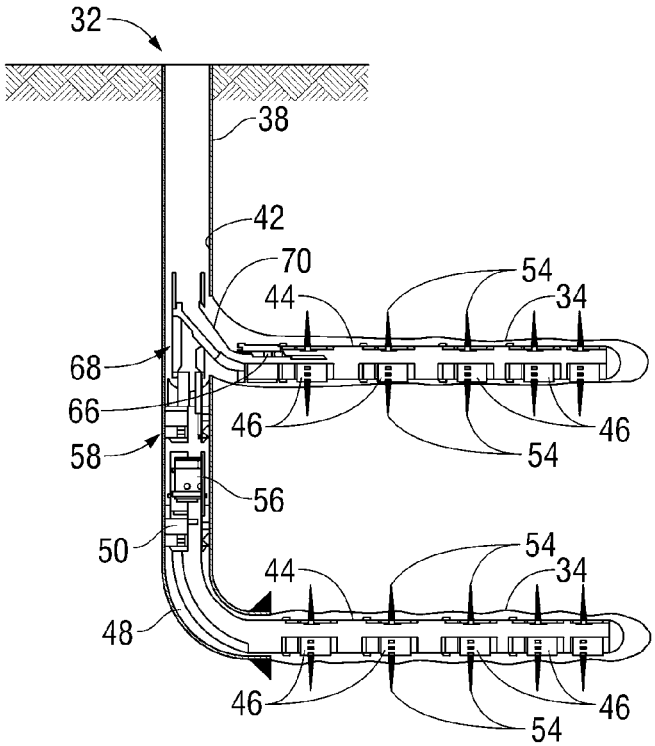
FIG. 11 is an illustration similar to that of FIG. 10 showing preparation of the well for production, according to an embodiment of the present invention.
Figure 12:
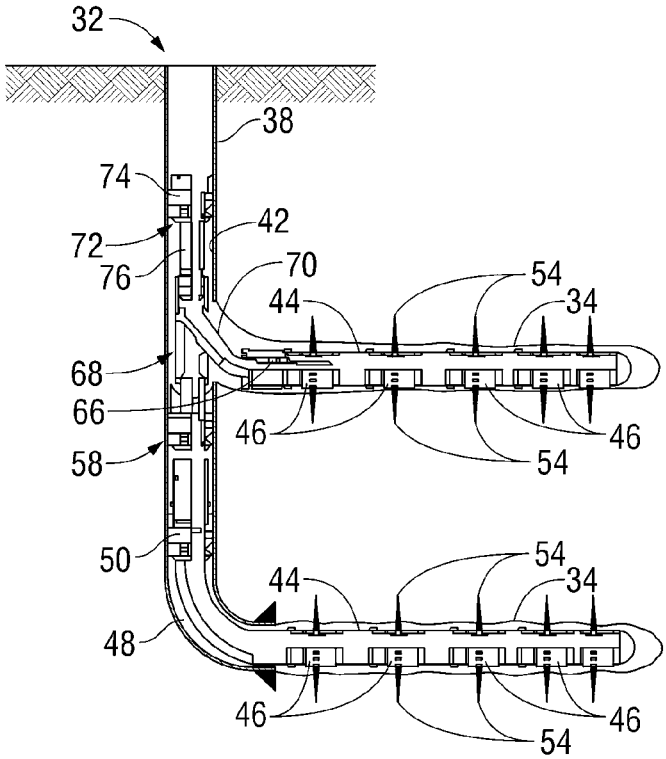
FIG. 12 is an illustration similar to that of FIG. 11 showing placement of an upper packer to prepare the well for production and/or formation of another lateral wellbore, according to an embodiment of the present invention.

At this stage, an extension and rapid connect template assembly 68 may be run downhole for engagement with the remaining portion of whipstock assembly 58, as illustrated in FIG. 10. This enables a connector tubing 70 to be connected between packer 66 and rapid connect template assembly 68, as illustrated in FIG. 11. The connector tubing 70 may comprise, for example, spacer pups and a rapid connect connector. Subsequently, a packer assembly 72 is deployed downhole for engagement with an upper portion of the extension and rapid connect template assembly 68, as illustrated in FIG. 12. In this embodiment, packer assembly 72 comprises a packer 74 that may be actuated to seal against casing 42 in vertical wellbore section 38. The packer assembly 72 also may comprise a tubing 76 that extends between packer 74 and the rapid connect template assembly 68. Depending on the application, packer assembly 72 also may comprise a variety of other or additional components, such as crossovers, pups, seals and other components to facilitate production of hydrocarbon fluids.

The isolation device 56, e.g. plug, also is removed from engagement with the on-off tool 50. If a sufficient number of lateral wellbores 34 have been formed, the isolation device may be removed completely to enable production from multilateral well 32. If, on the other hand, additional lateral wellbores are to be formed, the isolation device 56 may again be used to isolate the lateral wellbores that have already been fractured while a subsequent lateral wellbore 34 is drilled and then fractured. Because of the components utilized and the sequence of the procedure, the fracturing and completing of the multiple lateral wellbores are achieved during a single mobilization of surface equipment 40.

Figure 13:
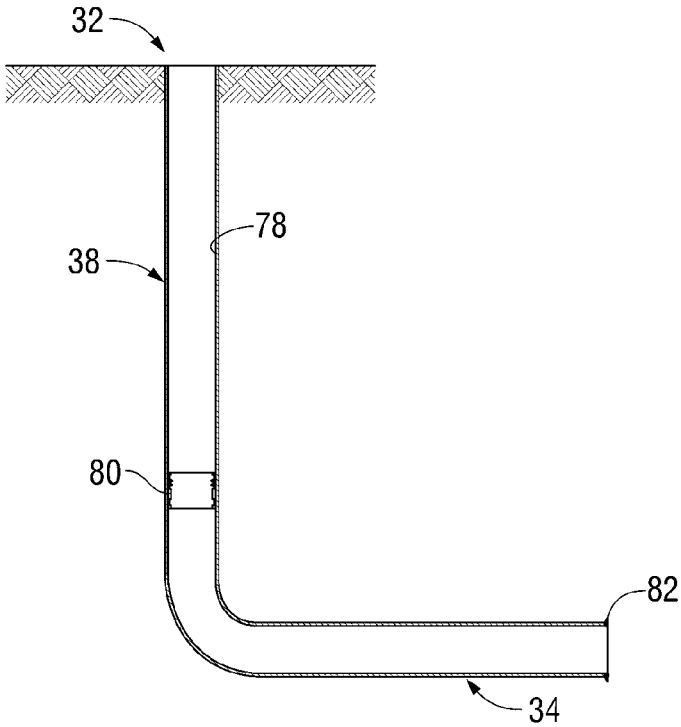
FIG. 13 is an illustration of a well in which an initial lateral wellbore has been formed, according to an alternate embodiment of the present invention.

Referring generally to FIGS. 13-27, another embodiment of the technique for multilateral, multistage stimulation is illustrated. In this embodiment, all of the lateral wellbores 34 are initially formed, e.g. drilled, and then the lateral wellbores are batch completed during a single mobilization. As illustrated in FIG. 13, the multilateral well 32 is initially formed with the first lateral wellbore 34. The multilateral well 32 may then be logged and lined with a casing 78 that extends generally through vertical wellbore section 38 and lateral wellbore 34. A casing coupling 80 may be positioned in the vertical wellbore section 38 a short distance above lateral wellbore 34. Additionally, a casing shoe 82 may be positioned at a distal end of the casing extending along lateral wellbore 34.

Figure 14:
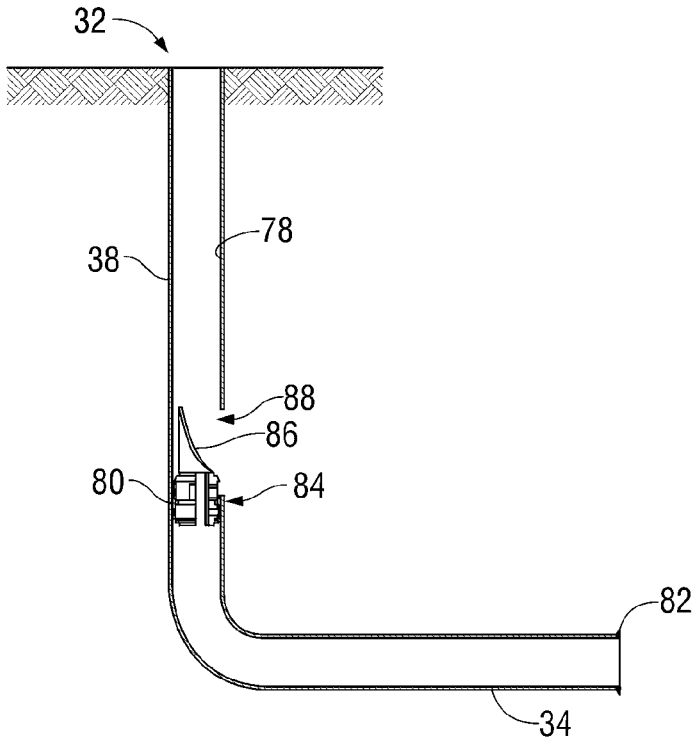
FIG. 14 is an illustration similar to that of FIG. 13 showing placement of a whipstock to enable formation of a subsequent lateral wellbore, according to an alternate embodiment of the present invention.
Figure 15:
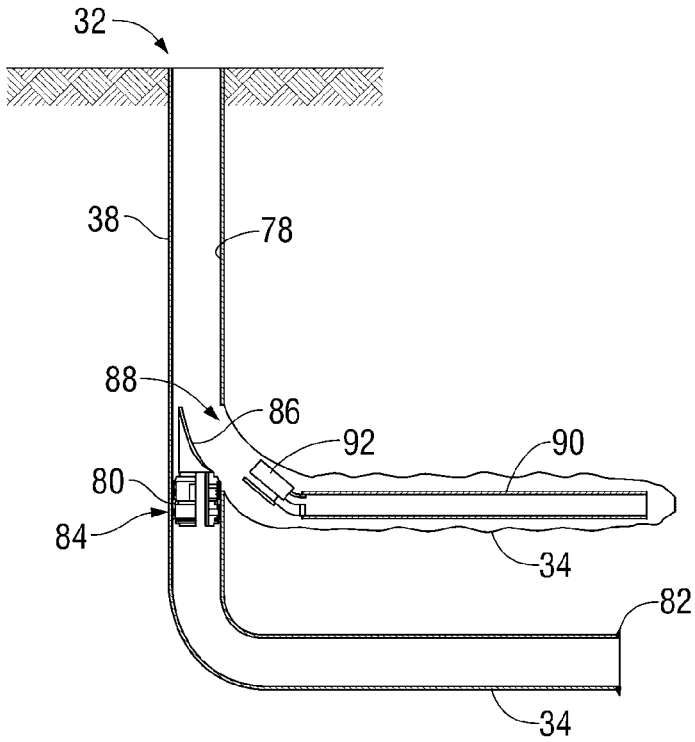
FIG. 15 is an illustration similar to that of FIG. 14 but showing a liner in the subsequent lateral wellbore, according to an alternate embodiment of the present invention.

Subsequently, a whipstock assembly 84 is run downhole into engagement with casing coupling 80, as illustrated in FIG. 14. The whipstock assembly 84 comprises a whipstock 86 which facilitates formation of a casing opening 88 through casing 78. By way of example, casing opening 88 may be milled through the casing wall to enable formation, e.g. drilling, of the second lateral wellbore 34, as illustrated in FIG. 15.

After drilling the second lateral wellbore 34, a lateral liner 90 is deployed in the second lateral wellbore 34. A polished bore receptacle 92 may be mounted at a top/near end of the lateral liner 90. Furthermore, the lateral liner 90 may be cemented into place within lateral wellbore 34.

Figure 16:
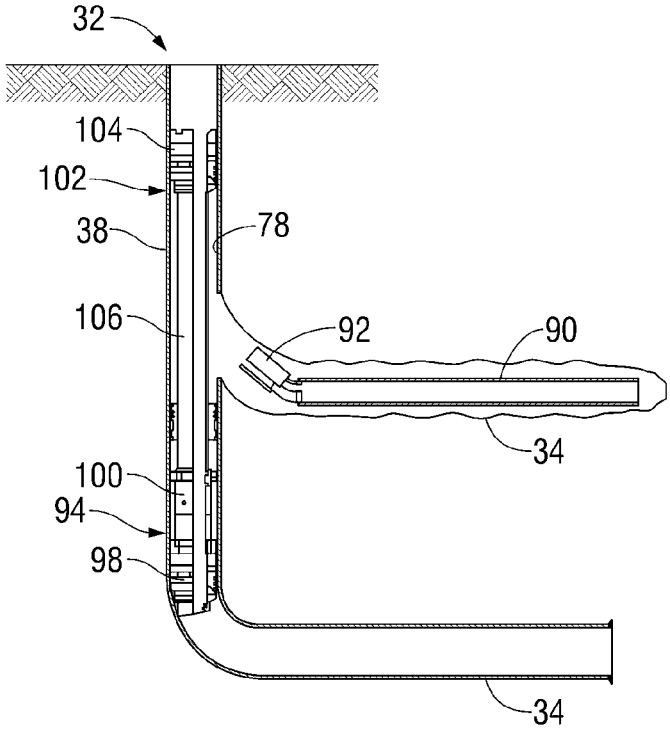
FIG. 16 is an illustration similar to that of FIG. 15 but illustrating deployment of fracturing equipment downhole, according to an alternate embodiment of the present invention.

As illustrated in FIG. 16, the whipstock assembly 84 may then be pulled to enable deployment of a packer assembly 94 which is set against the surrounding casing 78 in generally vertical wellbore section 38 directly above the initial lateral wellbore 34. Packer assembly 94 may comprise a packer 98 and a riser 100 extending upwardly from packer 98 within vertical wellbore section 38 between the lateral wellbores 34. After setting packer 98, a second packer assembly 102 is delivered downhole and connected, e.g. landed, in riser 100. The second packer assembly 102 comprises a packer 104 and a tubing 106 that extends downwardly from packer 104 and into engagement with riser 100 via, for example, a seal assembly.

Figure 17:
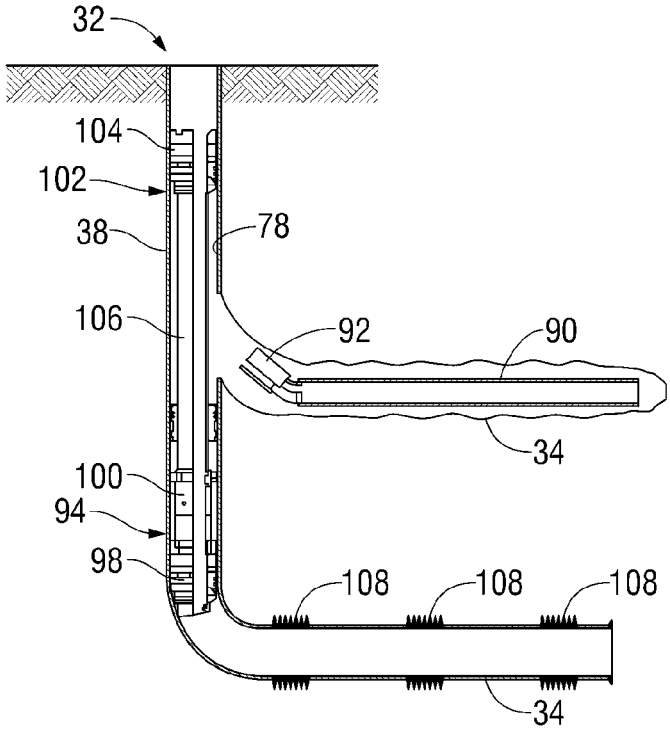
FIG. 17 is an illustration similar to that of FIG. 16 in which the initial lateral wellbore has been fractured, according to an alternate embodiment of the present invention.

The process of forming lateral wellbores 34 may be repeated until the desired number of lateral wellbores 34 is formed and completed with appropriate liner assemblies. At this stage, fracturing fluid is pumped downhole, through packer assemblies 102 and 94, and into the initial, e.g. lowermost, lateral wellbore 34 to conduct a fracturing procedure in which a plurality of fractures 108 are formed, as illustrated in FIG. 17. Flow testing and other testing may then be performed on the fractured lateral wellbore.

Figure 18:
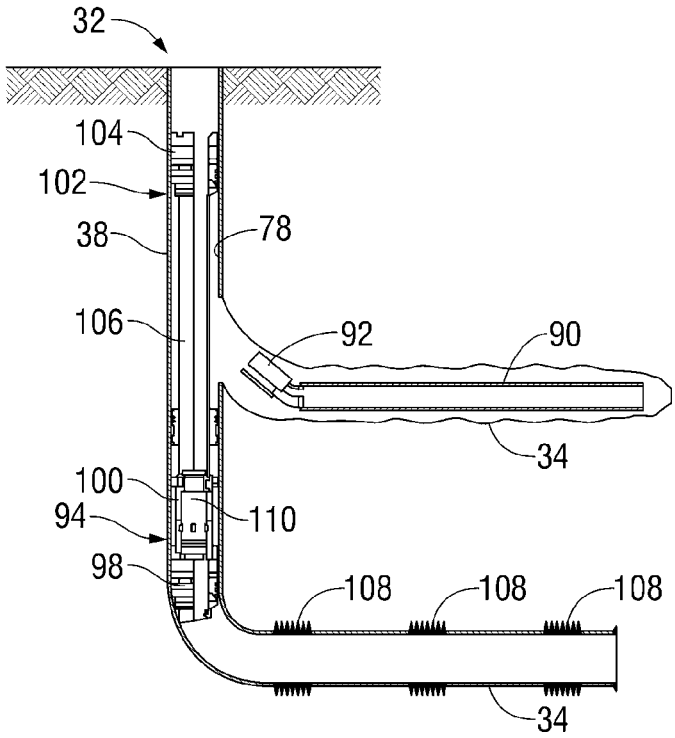
FIG. 18 is an illustration similar to that of FIG. 17 but showing isolation of the initial lateral wellbore, according to an alternate embodiment of the present invention.

Once this initial lateral wellbore 34 is fractured and tested, an isolation device 110, e.g. a plug, is run downhole into proximity with the lower packer 98, as illustrated in FIG. 18. The isolation device 110 serves to isolate the next sequential lateral wellbore 34 from the lateral wellbore or wellbores that have already been fractured.

Figure 19:
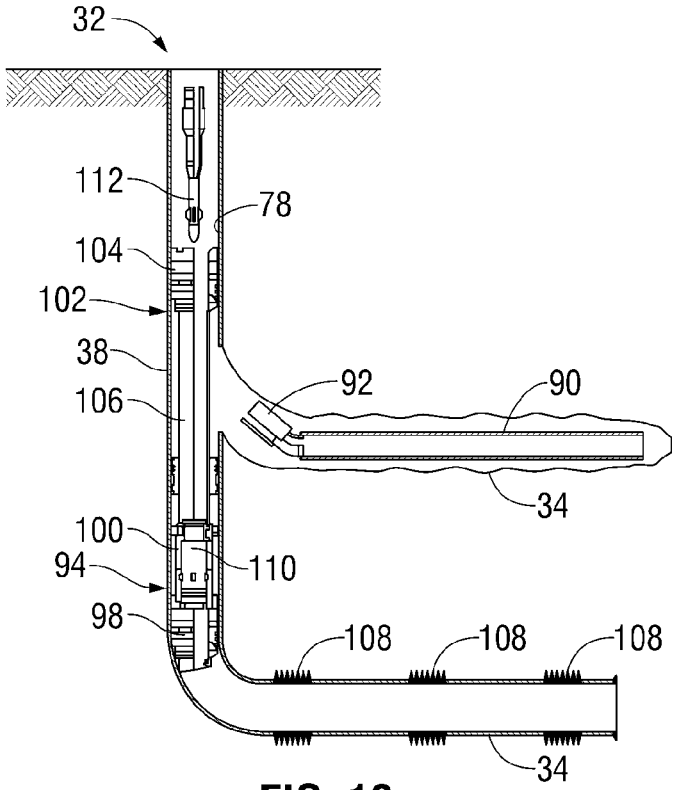
FIG. 19 is an illustration similar to that of FIG. 18 but showing preparation of the subsequent lateral wellbore for fracturing, according to an alternate embodiment of the present invention.
Figure 20:
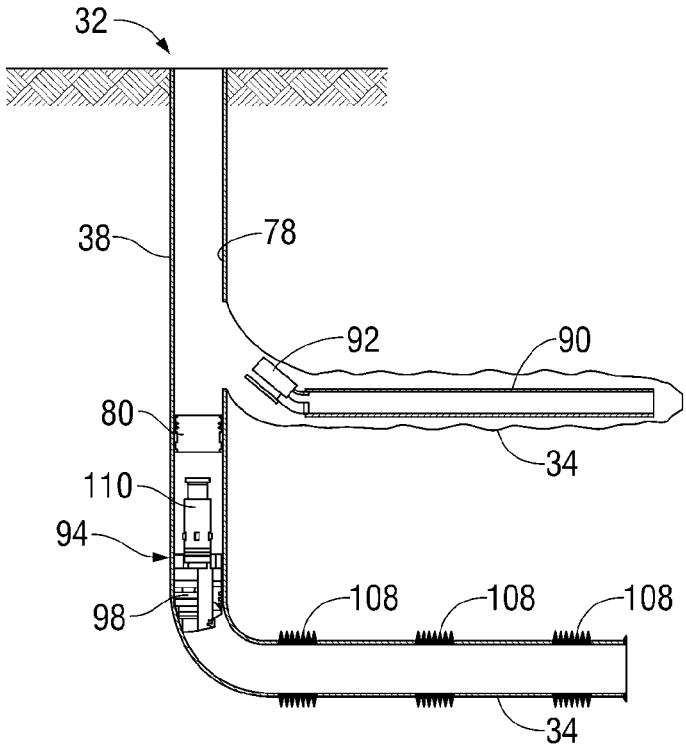
FIG. 20 is an illustration similar to that of FIG. 18 showing additional preparation of the subsequent lateral wellbore for fracturing, according to an alternate embodiment of the present invention.

A retrieval tool 112 is then run downhole, as illustrated in FIG. 19. The retrieval tool 112 is used to retrieve upper packer 104 and tubing 106, as illustrated in FIG. 20. Other components also may be retrieved as desired to facilitate fracturing of the next sequential lateral wellbore 34. Additionally, the riser 100 or portions of the riser 100 may be removed from its location in vertical wellbore section 38 between lateral wellbores 34. For example, the riser 100 may comprise an overshot seal assembly that is removed via retrieval tool 112. Overshot seal assemblies may be used in this embodiment to facilitate engagement with second packer assembly 102 and in other embodiments to facilitate engagement between components delivered downhole.

Figure 21:
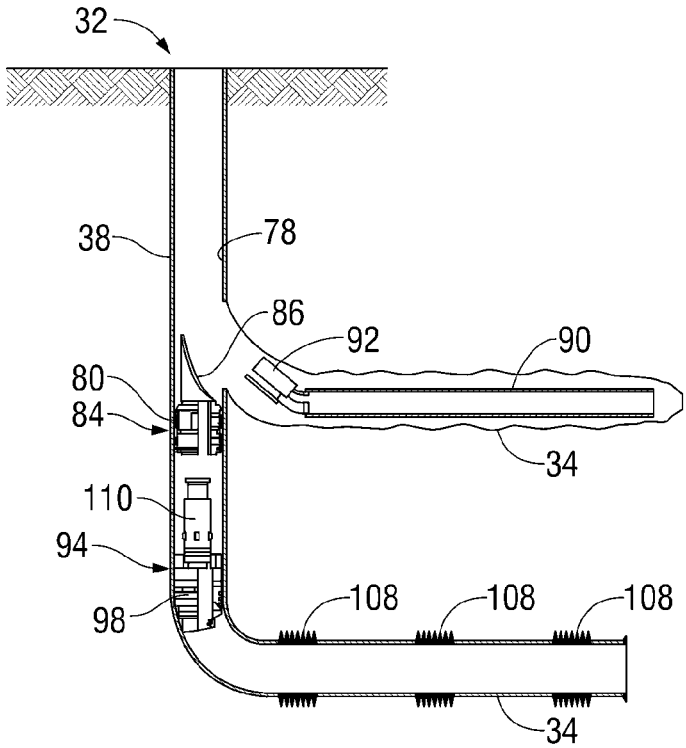
FIG. 21 is an illustration similar to that of FIG. 20 showing additional preparation of the subsequent lateral wellbore for fracturing, according to an alternate embodiment of the present invention.
Figure 22:
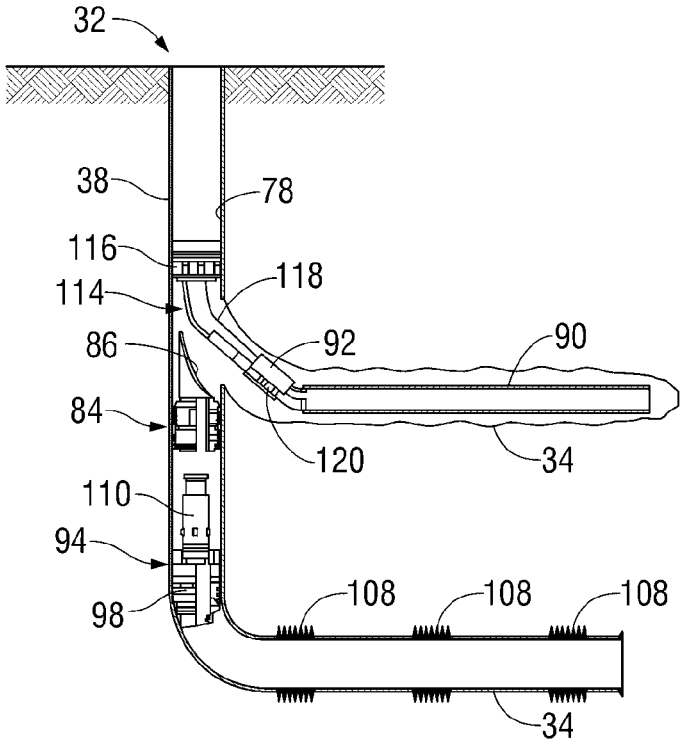
FIG. 22 is an illustration similar to that of FIG. 21 showing additional preparation of the subsequent lateral wellbore for fracturing in which the subsequent lateral wellbore has been isolated for delivery of fracturing fluid, according to an alternate embodiment of the present invention.

Subsequently, whipstock assembly 84 is again moved downhole into engagement with casing coupling 80, as illustrated in FIG. 21. The whipstock assembly 84 and its whipstock 86 facilitate deployment of a packer assembly 114 designed to facilitate fracturing, as illustrated in FIG. 22. In this example, packer assembly 114 comprises a packer 116 and a tubing structure 118 that extends from packer 116 into polished bore receptacle 92. By way of example, tubing structure 118 may comprise a seal assembly 120 designed to stab into the polished bore receptacle 92.

Figure 23:
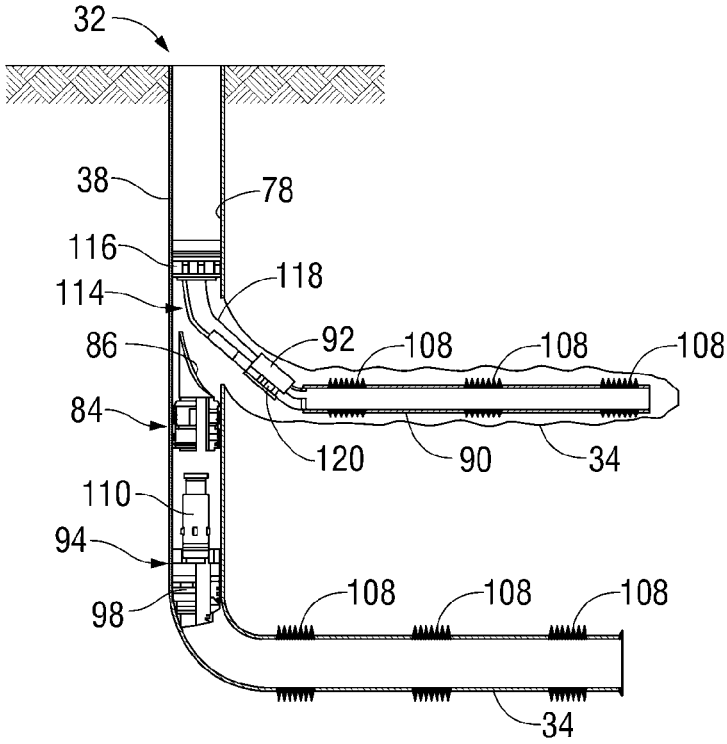
FIG. 23 is an illustration similar to that of FIG. 22 in which the subsequent lateral wellbore has been fractured, according to an alternate embodiment of the present invention.

Once tubing 118 is engaged with polished bore receptacle 92 and packer 116 is set, a fracturing procedure may be performed. During the fracturing procedure, fracturing fluid is pumped downhole through packer 116, through tubing structure 118, and into the subsequent, e.g. upper, lateral wellbore 34 to create multiple fractures 108, as illustrated in FIG. 23. The subsequent lateral wellbore 34 may then be subjected to flow tests and other tests prior to production.

Figure 24:
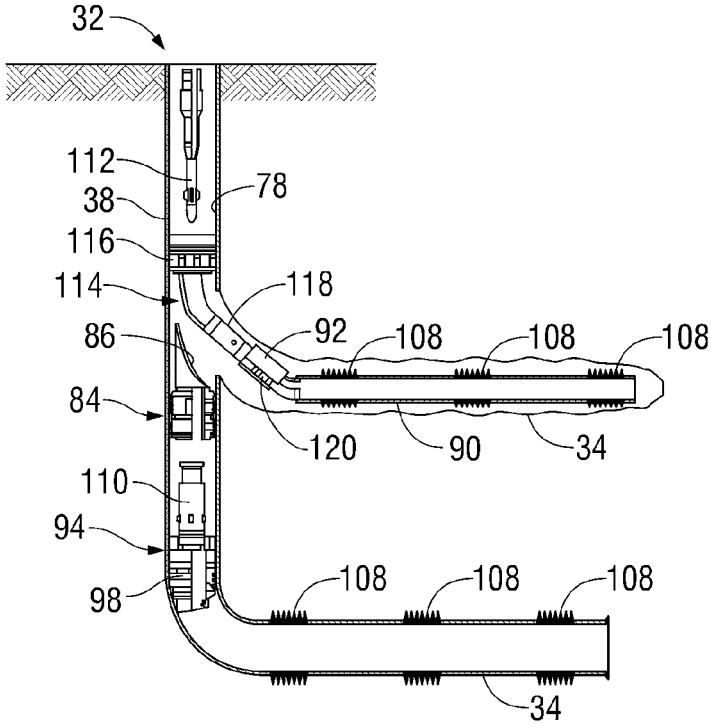
FIG. 24 is an illustration showing delivery of a retrieval tool downhole to retrieve equipment used in the fracturing operation, according to an alternate embodiment of the present invention.
Figure 25:
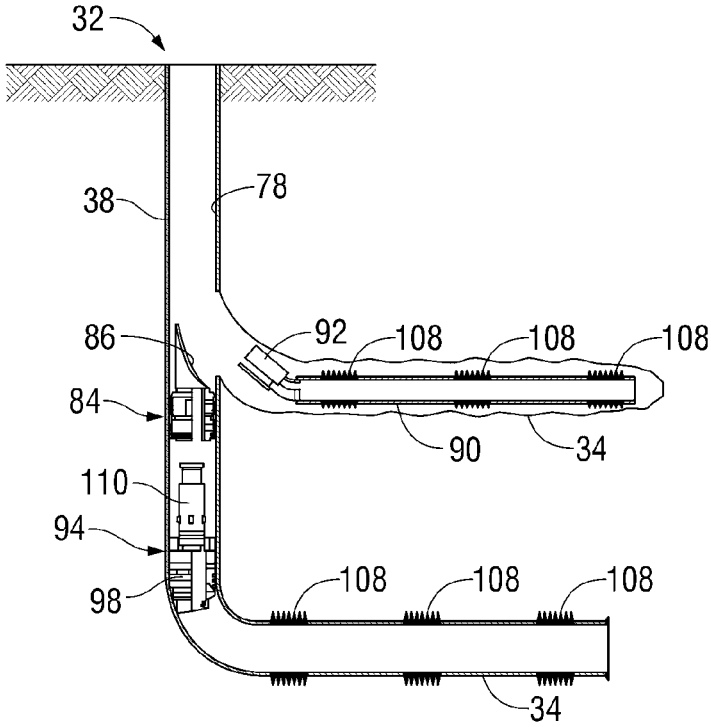
FIG. 25 is an illustration similar to that of FIG. 23 illustrating preparation of the well for production and/or formation of an additional lateral wellbore, according to an alternate embodiment of the present invention.
Figure 26:
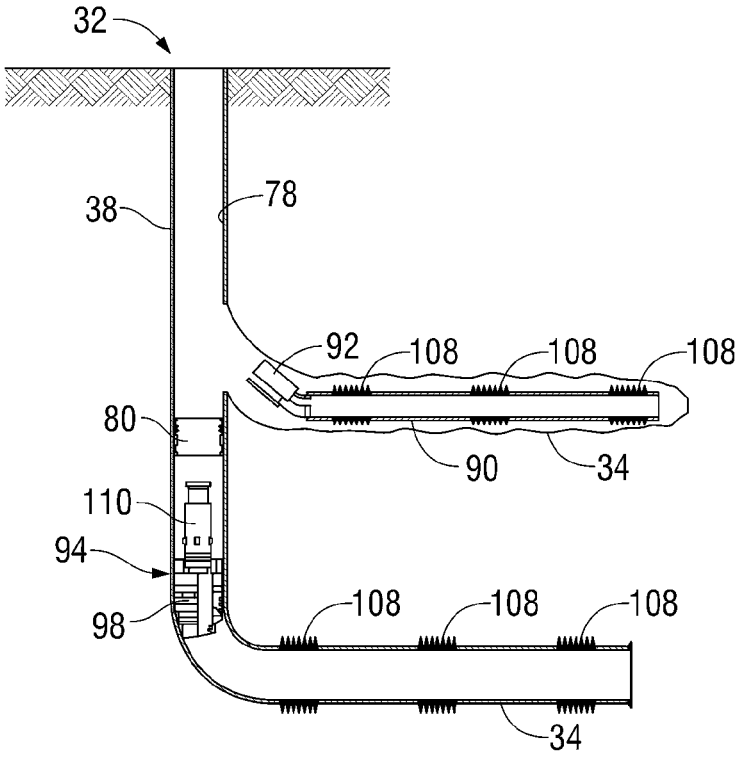
FIG. 26 is an illustration similar to that of FIG. 25 illustrating preparation of the well for production and/or formation of an additional lateral wellbore, according to an alternate embodiment of the present invention.

After completing testing of the subsequent lateral wellbore 34, retrieval tool 112 is run downhole and engaged with packer 116, as illustrated in FIG. 24. The packer 116 is then released and the entire packer assembly 114 may be removed from polished bore receptacle 92 and retrieved up through vertical wellbore section 38, as illustrated in FIG. 25. Similarly, the whipstock assembly 84 also may be retrieved, as further illustrated in FIG. 26. Once all of the desired lateral wellbores 34 are formed, the isolation device 110 also may be removed to ultimately enable flow of production fluid from all of the lateral wellbores. Again, because of the components utilized and the sequence of the procedure, the fracturing and completing of the multiple lateral wellbores are achieved during a single mobilization of surface equipment 40.

Figure 27:
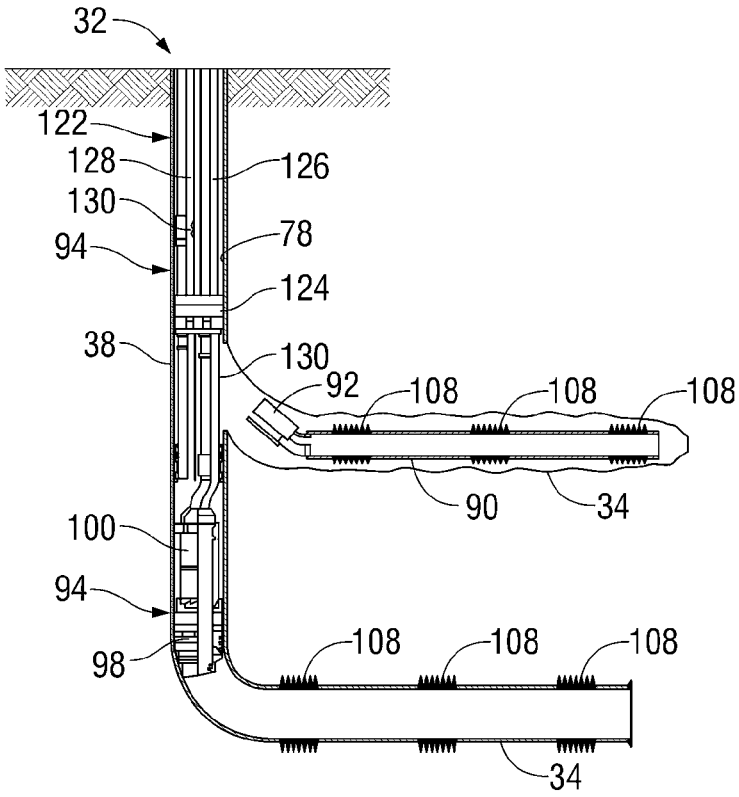
FIG. 27 is an illustration similar to that of FIG. 26 in which production equipment has been deployed downhole into the well to enable production of hydrocarbon fluid from the plurality of lateral wellbores, according to an alternate embodiment of the present invention.

Removal of the fracturing equipment enables deployment of production completion equipment 122, as illustrated in FIG. 27. The completion equipment 122 may vary from one application to another depending on the environment, the number of lateral wellbores, and other factors affecting production of hydrocarbon fluids. By way of example, completion equipment 122 may comprise an upper packer 124 positioned in generally vertical wellbore section 38 above lateral wellbores 34 to seal off the multilateral well 32 against unwanted fluid flow. The completion equipment 122 may also comprise a plurality of tubing strings 126, 128 that are in fluid communication with corresponding lateral wellbores 34. For example, tubing string 126 extends down through upper packer 124 and into engagement with riser 100 to conduct flow of well fluids from the lower lateral wellbore 34. Similarly, tubing string 128 extends down through packer 124 and into proximity with the upper lateral wellbore 34 to conduct flow of well fluids from the upper lateral wellbore. However, completion equipment 122 may comprise a variety of other components 130, including control lines, sensor systems, flow control valves, flow control manifolds, and other components to facilitate production of fluids from the lateral wellbores 34.

The embodiments described above provide examples of systems and methodologies for incorporating multistage fracturing techniques with multilateral wellbores. As described, the fracturing of all lateral wellbores may be completed in a single completion run with a single rig mobilization. Furthermore, the lateral wellbores may be drilled and completed with multistage fracturing technologies incorporating cemented liners, open hole systems, or other suitable systems. A completion string is then run to tie-in each lateral wellbore with completion tubing to the surface, as illustrated in FIG. 27.

Figure 28:
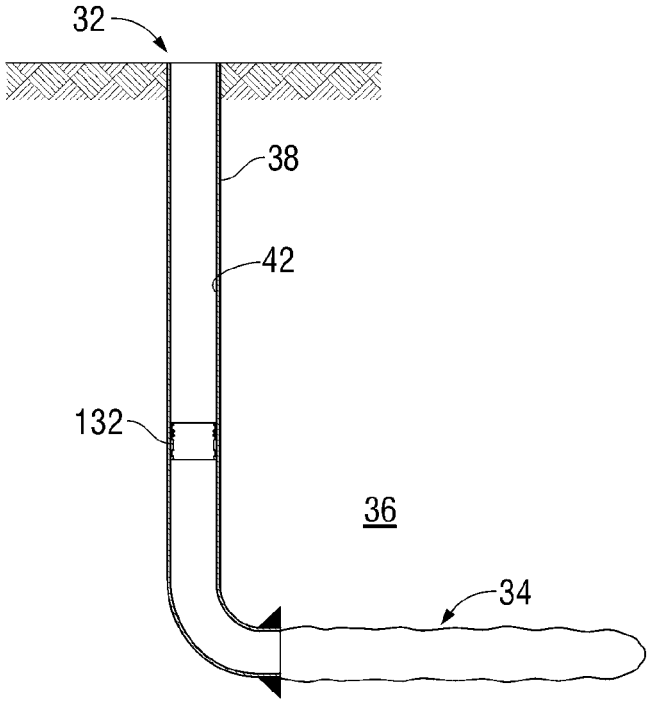
FIG. 28 is an illustration of another well in which an initial lateral wellbore has been formed, according to an alternate embodiment of the present invention.
Figure 29:
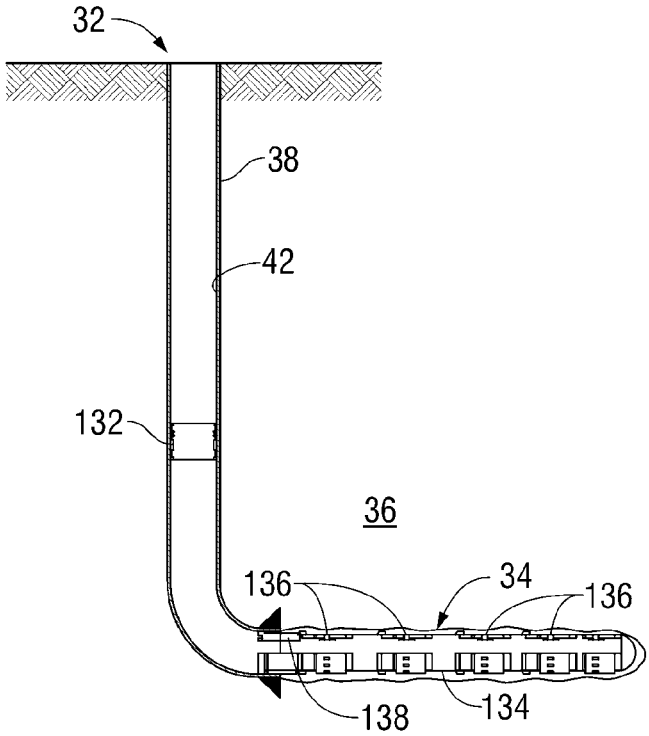
FIG. 29 is an illustration similar to that of FIG. 28 showing placement of a lateral liner with isolation valves in a lateral wellbore, according to an alternate embodiment of the present invention.

Referring generally to FIGS. 28-37, another embodiment of the technique for multilateral, multistage stimulation is illustrated. In this embodiment, the multilateral well 32 is initially formed by drilling the main, generally vertical wellbore 38. Casing 42 is then run into the vertical wellbore 38 with an indexed casing collar 132; and the first open hole, lateral wellbore 34 is drilled, as illustrated in FIG. 28. At this stage, a lower lateral liner 134 with a plurality of isolation valves 136 and at least one isolation packer 138 may be run into the lower lateral wellbore 34, as illustrated in FIG. 29. In some applications, lateral liner 134 may be cemented into place in the lateral wellbore.

Figure 30:
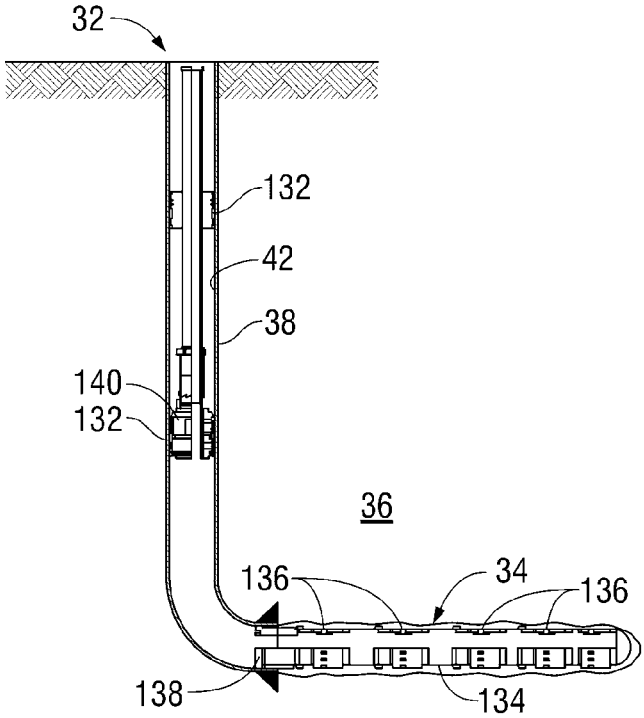
FIG. 30 is an illustration similar to that of FIG. 29 but showing a construction selective landing tool run into the generally vertical wellbore, according to an alternate embodiment of the present invention.
Figure 31:
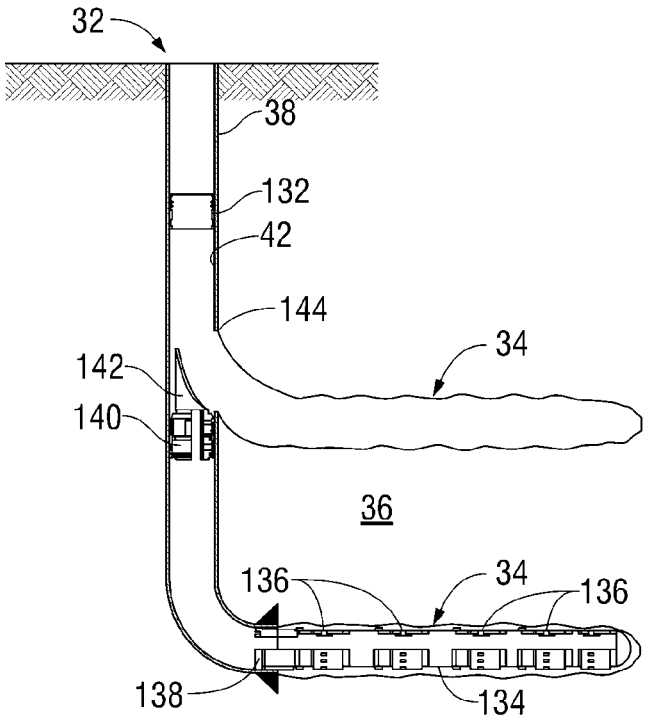
FIG. 31 is an illustration similar to that of FIG. 30 but showing deployment of a whipstock assembly and formation of a subsequent lateral wellbore, according to an alternate embodiment of the present invention.

Subsequently, a construction selective landing tool 140 is run downhole to the indexed casing collar 132 and a casing collar slot orientation is determined, as illustrated in FIG. 30. As illustrated, an upper indexed casing collar 132 also may be positioned along generally vertical wellbore section 38. A whipstock 142 is then adjusted at the surface with respect to the construction selective landing tool 140 and run downhole to the lower indexed casing collar 132, as illustrated in FIG. 31. The whipstock 142 enables milling of a window 144 through casing 42. Following the milling, a cleanout trip may be performed prior to running a bottomhole assembly used to drill a second and upper lateral wellbore 34, as further illustrated in FIG. 31.

Figure 32:
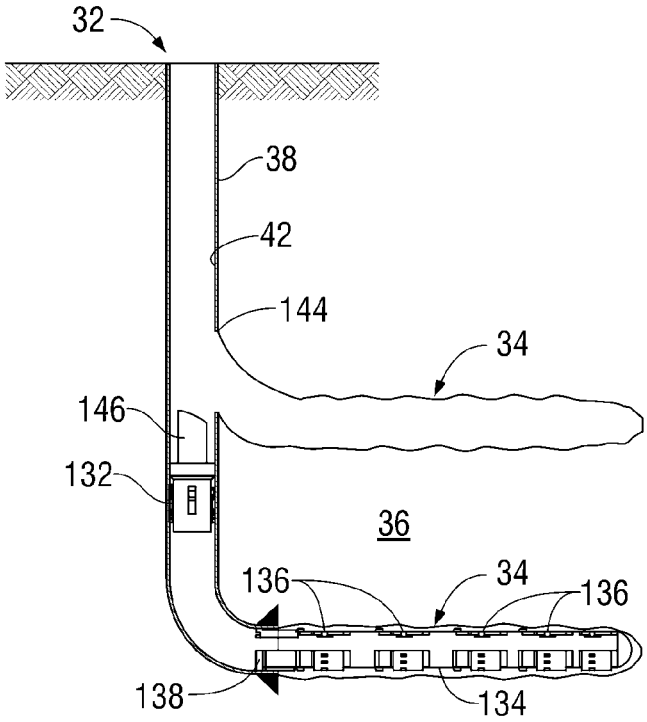
FIG. 32 is an illustration similar to that of FIG. 31 in which the whipstock has been retrieved and a selective through tubing access deployed, according to an alternate embodiment of the present invention.
Figure 33:
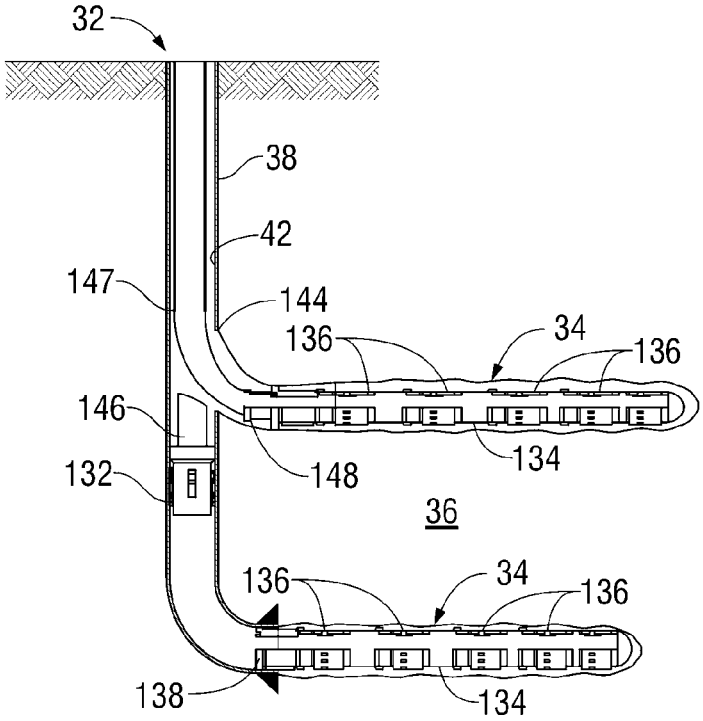
FIG. 33 is an illustration similar to that of FIG. 32 but showing isolation valves and other equipment run into the subsequent lateral wellbore, according to an alternate embodiment of the present invention.

The whipstock 142 is then retrieved to enable running of a selective through tubing access deflector 146, as illustrated in FIG. 32. The selective through tubing access deflector 146 is run down through vertical wellbore section 38 to the lower indexed casing collar 132. Subsequently, another lateral liner 134 with isolation valves 136 is run downhole into the upper lateral wellbore 34, as illustrated in FIG. 33. The lateral liner 134 may be run with an outer selective through tubing access retrieving sleeve 147 and a polished bore receptacle 148. Once the equipment is deployed in the upper lateral wellbore, the liner running tool may be pulled. This allows the drilling rig to be moved off the multilateral well 32, and the work-over rig and pumping units to be moved onto the well.

Figure 34:
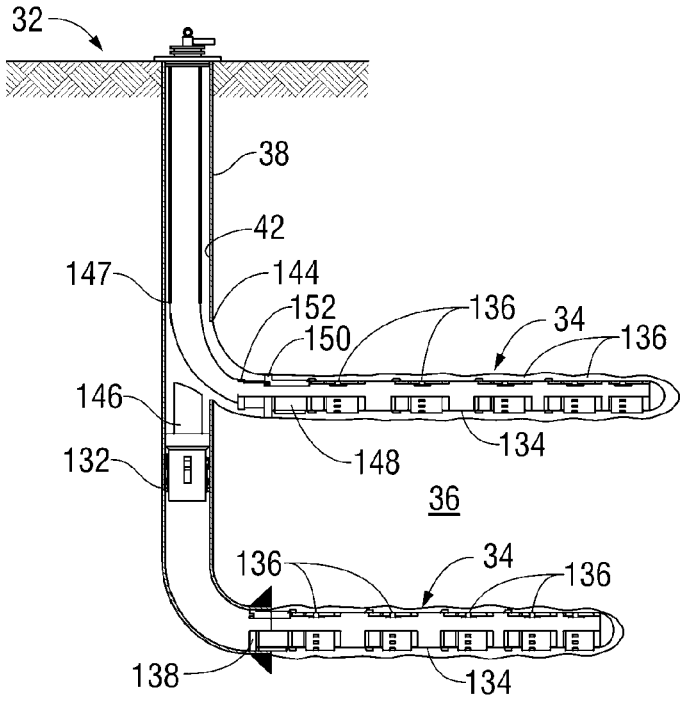
FIG. 34 is an illustration similar to that of FIG. 33 in which the multilateral wellbore has been prepared for fracturing of the upper lateral, according to an alternate embodiment of the present invention.
Figure 35:
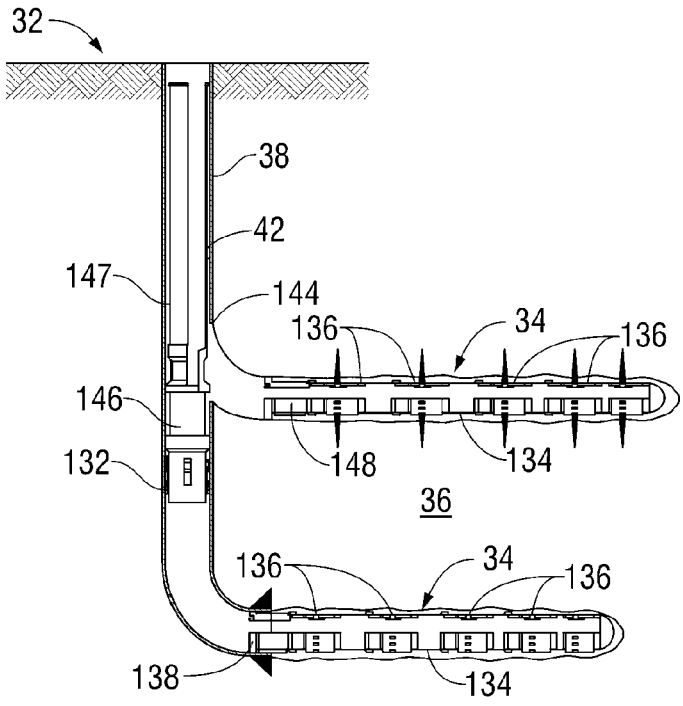
FIG. 35 is an illustration similar to that of FIG. 34 in which a retrieving sleeve has been lowered into the wellbore to retrieve the selective through tubing access, according to an alternate embodiment of the present invention.

As illustrated in FIG. 34, a seal assembly 150 and a selective through tubing access sleeve engagement tool 152 may be run downhole and engaged with polished bore receptacle 148. A fracturing treatment is then performed on the upper lateral wellbore 34 while isolated from the lower lateral wellbore. If the upper lateral liner 134 needs to be cemented, the cementing operation may be performed when running the lateral liner or in a separate trip downhole. Following the fracturing operation, the seal assembly 150 is pulled with the selective through tubing access retrieving sleeve 147, and the retrieving sleeve 147 is again lowered for engagement with the selective through tubing access deflector 146, as illustrated in FIG. 35. An upward pull is applied to the retrieving sleeve 147 to release the selective through tubing access deflector 146 and the entire assembly is pulled from the well.

Figure 36:
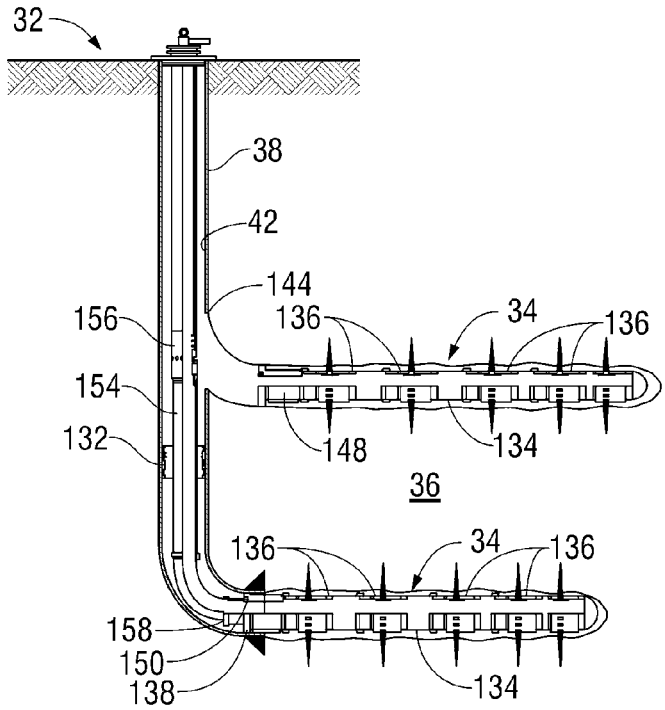
FIG. 36 is an illustration similar to that of FIG. 35 in which the multilateral wellbore has been prepared for fracturing of the lower lateral, according to an alternate embodiment of the present invention.
Figure 37:
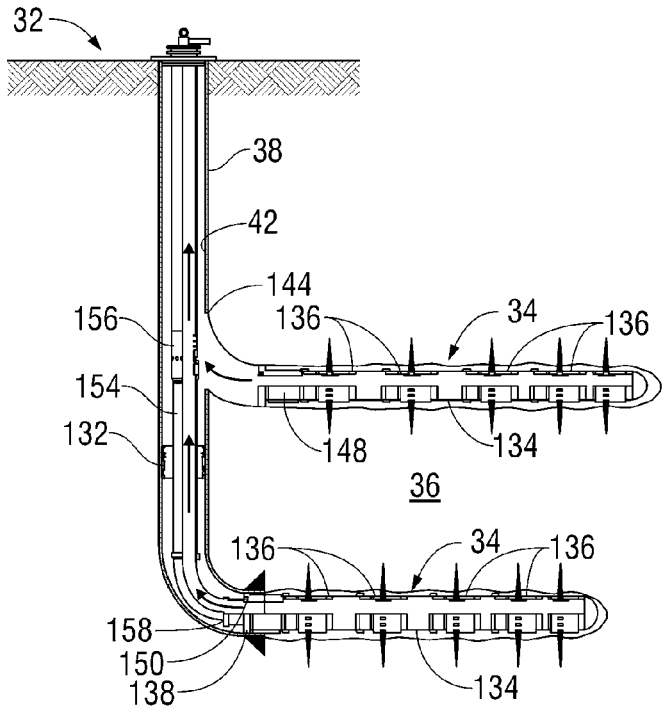
FIG. 37 is an illustration similar to that of FIG. 36 in which the multilateral well has been completed with a sliding sleeve which can be opened for comingled production, according to an alternate embodiment of the present invention.

Subsequently, a seal assembly, e.g. seal assembly 150, is run downhole to the lower lateral wellbore 34 on a work string 154 with a sliding sleeve 156, as illustrated in FIG. 36. A proper space out is employed to land the tubing hanger and seals in a corresponding polished bore receptacle 158. This allows a fracturing operation to be performed on the lower lateral wellbore 34, as further illustrated in FIG. 36, while the lower lateral wellbore 34 is isolated via isolation packer 138. The pumping units may then be moved from over the well, and the lateral wellbores 34 may be separately flowed and tested via operation of sliding sleeve 156. In some applications, an upper packer also is run. At this stage, the multilateral well 32 is completed, and sliding sleeve 156 may be opened for comingled production, as illustrated in FIG. 37.

It should be noted the well completion and fracturing methodologies described herein may be adjusted to suit a variety of wells, environments, and types of equipment. For example, a variety of components may be used to control the distribution of fracturing fluid to the specific lateral wellbore being treated at a given time. As described above, diversion systems, such as packer assemblies and manifold type devices, may be utilized to control the flow of fracturing fluid to specific lateral wellbores. During fracturing, all other lateral wellbores are hydraulically isolated from the fracturing tubing string. Additionally, a variety of components and technologies may be used to distribute the fracturing fluid. For example, various commercially available valve systems may be employed to control the flow of fracturing fluid. In some applications, valves or sleeves are shifted mechanically by coiled tubing or slickline. In other applications valve systems may utilize valves that are opened and closed by pressure cycling, electrical input, hydraulic input, or other techniques. In at least some embodiments, the ability to perform the multilateral, multistage stimulation during a single rig mobilization enables the continuous pumping of fracturing fluid during fracturing of multiple lateral wellbores.

Additionally, the well system may be formed with many types of components for use with many types of well systems. The types of packers, whipstocks, tubing, seal assemblies, isolation devices, retrieval tools, and other components may vary from one operation to another. The various components can be selected and optimized according to the specific application and environment in which the components are utilized. Additionally, the number, length, and orientation of the lateral wellbores may be adjusted according to the reservoir and the available hydrocarbon-based fluids in a given oilfield project.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of preparing a well, comprising:

forming a well with a plurality of lateral wellbores;

installing a selective through tubing access deflector between each respective pair of lateral wellbores; and fracturing the plurality of lateral wellbores continuously during a single completion run, wherein the fracturing comprises:

connecting a fracturing tubing string to the uppermost lateral wellbore and fracturing the uppermost lateral wellbore; and sequentially connecting the fracturing tubing string to each lateral wellbore in descending order and fracturing each lateral wellbore in descending order.

2. The method as recited in claim 1, wherein forming the well comprises completing each lateral wellbore after drilling each lateral wellbore.

3. The method as recited in claim 1, wherein forming the well comprises drilling all lateral wellbores of the plurality of lateral wellbores and then batch completing the plurality of wellbores.

4. A method of preparing lateral wellbores, comprising:

drilling a plurality of lateral wellbores from a generally vertical wellbore;

installing a selective through tubing access deflector between each respective pair of lateral wellbores;

fracturing the plurality of lateral wellbores in a single completion run by isolating sequential lateral wellbores of the plurality of lateral wellbores in descending order and delivering fracturing fluid to each sequential lateral wellbore while isolated.

5. The method as recited in claim 4, wherein drilling a plurality of lateral wellbores comprises drilling a plurality of generally horizontal lateral wellbores.

6. The method as recited in claim 4, further comprising employing a liner with valves in each lateral wellbore to control the fracturing of each lateral wellbore.

* * * * *

UNITED STATES PATENT AND TRADEMARK OFFICE

CERTIFICATE OF CORRECTION

PATENT NO. : 8,220,547 B2
APPLICATION NO. : 12/685513
DATED : July 17, 2012
INVENTOR(S) : Skeates et al.

It is certified that error appears in the above-identified patent and that said Letters Patent is hereby corrected as shown below:

On the Title page Item (12) please delete "Craig et al" and insert Item -- (12) Skeates et al. --

Signed and Sealed this
Eighteenth Day of December, 2012

David J. Kappos

David J. Kappos
*Director of the United States Patent and Trademark Office*